US005695833A

United States Patent [19]

Bok et al.

[11] Patent Number: 5,695,833

[45] Date of Patent: Dec. 9, 1997

[54] METHOD FOR UNIFORM FILM COATING OF SUBSTRATES

[76] Inventors: Hendrik F. Bok, 52 Thompson St., Fairhaven, Mass. 02719; Philip J. Birbara, 52 Elm St., Windsor Locks, Conn. 06096

[21] Appl. No.: 662,160

[22] Filed: Jun. 12, 1996

[51] Int. Cl.[6] ..... B06B 1/20

[52] U.S. Cl. ..... 427/600; 427/434.3; 427/434.5

[58] Field of Search ..... 427/601, 600, 427/434.3, 434.5; 118/410

[56] References Cited

U.S. PATENT DOCUMENTS

| | | | |
|---|---|---|---|
| 4,004,045 | 1/1977 | Stelter | 427/314 |
| 4,246,865 | 1/1981 | Shimada et al. | 427/601 |
| 4,307,128 | 12/1981 | Nagano et al. | 427/57 |
| 4,370,356 | 1/1983 | Bok et al. | 118/50.1 |
| 4,566,624 | 1/1986 | Comerford | 118/410 |
| 4,666,077 | 5/1987 | Rahn et al. | 118/410 |
| 4,696,885 | 9/1987 | Vijan | 430/311 |
| 4,757,781 | 7/1988 | Fukuda et al. | 118/410 |
| 4,848,642 | 7/1989 | Kondo | 118/410 |
| 5,270,079 | 12/1993 | Bok | 427/429 |

*Primary Examiner*—Katherine A. Bareford
*Attorney, Agent, or Firm*—David H. Semmes

[57] ABSTRACT

Method and apparatus for applying thin films of coating material with a high degree of uniformity, high utilization of coating fluid and superior adhesion characteristics are disclosed. According to the method, an inverted substrate is moved horizontally and countercurrent to a two stage coating fluid applicator assembly. The first coating stage utilizes megasonic pressure waves directed inclinedly upwardly through the coating fluid/substrate surface interface to wet, clean, degas and deposit coating fluid on the substrate surface. A second stage removes excess coating fluid at the substrate's trailing edge so as to precisely establish a thin and uniform coating film. After the coating has been applied, spinning of the substrate may be employed to enable further coating film uniformity and to increase the film's drying rate.

5 Claims, 5 Drawing Sheets

METHOD FOR UNIFORM FILM COATING OF SUBSTRATES

BACKGROUND OF THE INVENTION

1. Field of the Invention

The present invention relates to methods and apparatus for coating objects such as flat optics, flat panel displays and a variety of semiconductor surfaces. More specifically, the present invention relates to methods for applying uniform thin coatings by a closely coupled two stage coating fluid deposition process. Megasonic pressure waves imposed on fluid flowing from a first coating fluid stage in an inclinedly upwardly direction are utilized to wet, clean, degas, and deposit a coating film on the substrate surface. A closely coupled second stage serves to remove excess coating fluid so as establish a uniformly thin coating film. Further coating film leveling and increased film drying rates may be effected by the spinning of the substrate's surface. The compact configuration of the suggested coating assembly allows integration with cleaning and drying stages or processes. In this way, the many functions associated with the coating processes can be combined in a manner more amenable to continuous in-line production.

2. Description of the Prior Art

| INVENTOR | DATE | U.S. PAT. NO. |
|---|---|---|
| STETLER | 1/1977 | 4,004,045 |
| BOK | 1/1983 | 4,370,356 |
| VIJAN | 9/1987 | 4,696,885 |
| BOK | 12/1993 | 5,270,079 |

The application of precision thin coatings has received significant emphasis in the fabrication of flat panel displays such as high density television and lap top computer screens, mirrors and optical lenses. Semiconductor devices such as silicon and germanium wafers also require the application of a variety of uniformly deposited thin films.

Several methods of coating fluids onto substrate surfaces exist. These include spin, spray, dip, roller and meniscus coating processes. None of the coating methods employ megasonic energy applied directly to surface so as to degas the fluid and surface/fluid interface, promote uniform surface wetting and distribute the coating fluid uniformly so as to penetrate all surface topographical contours. Megasonic excitation induces shearing forces at the substrate surface/coating fluid interface that facilitates surface wetting by the displacement of surface adsorbed gases and adhering contaminant films. As a consequence, film adhesion characteristics are enhanced and the potential of film defects resulting from the subsequent outgasing of substrate surface adsorbed and dissolved coating fluid gases is minimized.

Spin coating processes utilize the combination of centrifugal and surface tension forces between the coating fluid and the substrate surface to effect the spreading outwardly of coating fluid on the substrate surface. One shortcoming is a substantial difference in coating thickness from the interior and the edge of the surface due to the centrifugal leveling process which contributes to the buildup of fluid at the edges of the surface. Another shortcoming is the wastage of coating fluid which is dispensed onto the surface in excessive quantities and discharged from the surface by rotational centrifugal forces. The possibility of particulate materials from the surroundings depositing onto the substrate's surface, the spinning of large surfaces at high RPMs and the removal of adsorbed gasses adhering to the contours of the surface's topography are additional areas of concern.

Dip coating methods have problems with the reproducibility and control of coating thickness. Dip coating processes are usually performed in a batch mode and as such require considerable handling from pre-cleaning to post-processing procedures; thus increasing the potential for surface recontamination.

Another method for applying coatings to a flat surface is described in U.S. Pat. No. 4,370,376. Coating fluid from a porous tube is applied from below to an inverted surface which is advanced tangentially to the flow of coating fluid. Menisci of coating fluid are supported at the leading and trailing edges by attractive forces between the coating fluid and the substrate surface. Since the laminar flow of the coating fluid is perpendicular to the surface, nearly equal quantities of fluid contacting the surface are drained on the trailing and leading edge sides of the coating applicator. The continual coating fluid supply and the fluid's surface tensile forces contribute to a buildup of coating fluid at the substrate's surface edge when the fluid breaks from the applicator.

The methods described in U.S. Pat. No. 5,270,079 are quite similar in concept to those of the previously cited U.S. Pat. No. 4,370,356. Both utilize porous tube applicators. They differ in operational procedures in that the flow of fluid is discontinued upon contact with the substrate surface. Interfacial attractive forces between the coating fluid and the substrate surface are subsequently utilized to deposit a thin coating film coat on the surface. Shortcomings of these methods include the slow rate of surface coating speeds due to the reliance on surface capillary attractive forces and the surface edge coating thickness variations attributable to difficulties in achieving a clean break of coating fluid from the porous tube applicator surface. Additionally, the entrapment of adsorbed surface gases compromises the film's adhesive characteristics and enhances the potential of film defect formation resulting from subsequent gaseous desorption.

Accordingly, improved methods for applying thin uniform and defect free precision coatings to flat substrate surfaces are desired. In addition, improved methods are desired for increasing the rate of coating deposition of thin films while simultaneously maintaining coating uniformity.

The features of this invention that are considered to be unique and improvements over prior art include: (1) the use of megasonic excitations in an inclinedly upward orientation: (2) the use of a wave generator to establish coating fluid/substrate surface contact; and (3) the use of a suction source to aid in the drainage of the meniscus volume prior to coating fluid detachment from the substrate surface. These disclosed features provide significant improvements in the state of the art which address deficiencies of present coating methods.

SUMMARY OF THE INVENTION

In accordance with the present invention, methods and apparatus are provided for applying thin uniform films of coating fluids to inverted flat substrate surfaces. The coating system includes the application of coating fluid to the surface by a closely coupled two stage coating fluid applicator assembly such that the coating fluid and surface move in relatively opposite directions. The surface of the object to be coated is contacted from below by the coating fluid directed inclinedly upwardly, such that surface tension forces between the surface and fluid form an interfacial contact area bounded by the leading and trailing edge menisci.

The first stage of the coating applicator assembly contains a first chambered structure such that fluid introduced to this chamber contacts the substrate surface and deposits an adhering coating film. Excess coating fluid flows over the downstream horizontal top surface defining a weir into a second coating fluid collection chamber. The opposite lateral side walls of the first chamber are sloped towards the leading edge meniscus so as to guide the fluid movement in an inclinedly upwardly direction towards the leading edge meniscus and opposite to the surface of the object to be coated.

A lateral slot is formed by a tubular element attached to the downstream sloped side wall which defines the top surface of a weir. Fluid dispensed from this lateral slot forms an elevated wave directed in an inclinedly upward direction. This height of this fluid wave is adjusted by controlling the flow so as to establish coating fluid/substrate surface interfacial contact.

Megasonic pressure waves are introduced to the volume of flowing coating fluid in the first chamber in a direction perpendicular to the upper surface of the megasonic transducer. The megasonic pressure waves generate shearing forces at the fluid/surface interfacial boundary that are primarily propagated in a direction generally opposed to the relative movement of the substrate surface. The megasonically induced shearing forces enhance the drainage of the coating fluid towards the trailing edge meniscus. These shearing forces promote surface wetting, cleaning as a result of the solubilizing of adhering surface contaminants, degassing of surface adsorbed gases and supplying coating fluid to all surface topographical features.

The second stage of the coating assembly is located immediately upstream of the first stage. A prime function is to drain excess coating fluid previously deposited so as to establish a uniformly thin coating film conforming to the surface's topographical features. Its horizontal top surface is slightly elevated above the horizontal surface of the first stage. The second stage's top surface is bounded by the inclined lateral side wall of the megasonically excited coating fluid chamber and a lateral downstream weir surface edge. The weir edge establishes the substrate's trailing edge meniscus. Excess coating fluid flows over the weir surface into the second stage's fluid collection chamber. Fluid collected within this chamber is subsequently transported via gravity drainage to the lower or second fluid collection chamber for recycling and/or disposal.

To reduce coating film thickness variations at the substrate's surface trailing edge, the volume of coating fluid contained within the meniscus may be reduced prior to coating fluid/substrate surface disengagement. Minimizing this volume contributes to a more precise film uniformity at the substrate's surface edge. A lateral slot located immediately upstream of the weir surface serves to remove this excess meniscus fluid by activating a suction source prior to coating fluid/substrate surface disengagement. The lateral slot is oriented in an inclinedly upwardly direction toward the substrate's trailing edge meniscus to facilitate coating fluid drainage. In this manner, the buildup of coating fluid at the substrate's trailing edge is minimized.

After the coating has been applied, spinning of the substrate's surface may be employed to enable further coating film uniformity and an increased film's drying rate.

The substrate surface coating operations are performed by the two stages of the applicator assembly. The basic processing steps upon which the present invention is based include:

a. Flowing the coating fluid in the first stage of coating fluid applicator assembly in an inclinedly upwardly direction in both the first chamber and the lateral slot of the wave generator to provide a uniform delivery of coating over a downstream horizontal weir edge into a second chamber, b. introducing megasonic pressure waves in the same direction as the flowing coating fluid within said first chamber, c. contacting the elevated coating fluid emanating from the wave generator's lateral slot with the surface of the object to be coated to establish menisci of the surface and the coating fluid, d. moving the surface of the object to be coated in a direction opposite to the coating fluid applicator assembly in an essentially horizontal orientation slightly above and parallel to the upper horizontal surfaces of the applicator assembly's two stages, e. maintaining the flow of coating fluid and megasonic excitation in the first chamber of the first applicator assembly to promote substrate surface wetting by displacing adsorbed surface gases, solubilizing adhering surface contaminants and expediting the penetration of coating fluid into surface pores and other surface microscale irregularities, f. draining excess coating fluid, resulting from the decreased distance between the second stage's upper surface to the substrate compared to that of the first stage, over a lateral weir edge which defines the location of the substrate's trailing edge meniscus, g. activating a suction source, prior to coating fluid detachment from the substrate surface, to aid in the drainage of excess coating fluid from the substrate surface's trailing edge meniscus through a lateral slot located immediately upstream of the second stage's weir edge and, h. optionally rotating the substrate surface to enable further coating leveling and to increase the coating's drying rate.

In another aspect of the present invention, an apparatus is provided for the coating of flat or curved planar surfaces of an object. The apparatus consists of sequential stages performing coating and leveling functions. The first stage of the coating applicator assembly apparatus includes:

a. a first chamber with an open top surface and a larger bottom surface which has a first slanted side wall having a horizontal top edge attached to an tubular element which forms a lateral slot facing in an inclined direction parallel to the first wall such that the horizontal upper edge of the tubular element serves as a weir, b. a second chamber that surrounds the first chamber with a closed bottom and with top surfaces that are lower than the first chamber's top surface such that coating fluid flowing over the weir of the first chamber are collected within the second chamber, c. a megasonic transducer whose upper surface forms the bottom of the first chamber and is attached to the slanted side walls of the first chamber such that pressure waves generated by the transducer are emitted in a direction perpendicular to the upper surface of the transducer.

The second stage of the coating applicator assembly apparatus includes:

a. a horizontal upper surface that terminates at an edge that serves as a weir for the drainage of coating fluid whose vertical elevation is slightly higher than the horizontal upper weir surface of the first stage, and b. a lateral slot located immediately upstream and parallel to the weir edge that serves to drain the meniscus fluid prior to coating fluid/substrate surface disengagement.

Further precision leveling, coating drying and processing control apparatus include:

a. a suction source that is activated prior to coating fluid/substrate disengagement, b. a heating unit to control the fluid and surface temperature levels, c. a filtration unit capable of removing particulate from the fluid recirculation loop.

d. an optional mechanical mechanism which rotates the coated surface to enable centrifugal forces to reduce coating thickness variations and accelerate coating drying.

By virtue of the practices of the present invention, precision coatings required for the processing steps involved in the fabrication of flat optic and flat substrate surfaces are realized.

DETAILED DESCRIPTION OF THE INVENTION

Although the configuration of objects being coated is not critical to the present invention, the methods and apparatus of the present invention are especially suited for the precision coating of flat substrate surfaces. Such surfaces include, but are not limited to, flat panel displays as are utilized in instrumentation and associated panels, lap top computers; optical devices such as mirrors and lenses; semiconductor devices such as silicon and germanium wafers, and the like. Materials to be coated include glass, metals, ceramics, plastics and combinations thereof. The precision coating may be a photo resist, polyimide, metallo-organic, anti-reflective, reflective, dopant, or the like.

The methods of the present invention are particularly suited for production oriented coating systems which address the application of precise uniform coating films with satisfactory adhesive characteristics.

The invention is further described with reference to the attached drawings. Those skilled in the art will recognize that the drawings are presented in a simplified or schematic form that does not illustrate various elements which are known to those skilled in the art, as for example, valves, switches, process control devices, heating elements, wiring, tubing, and the like.

Figure 1:
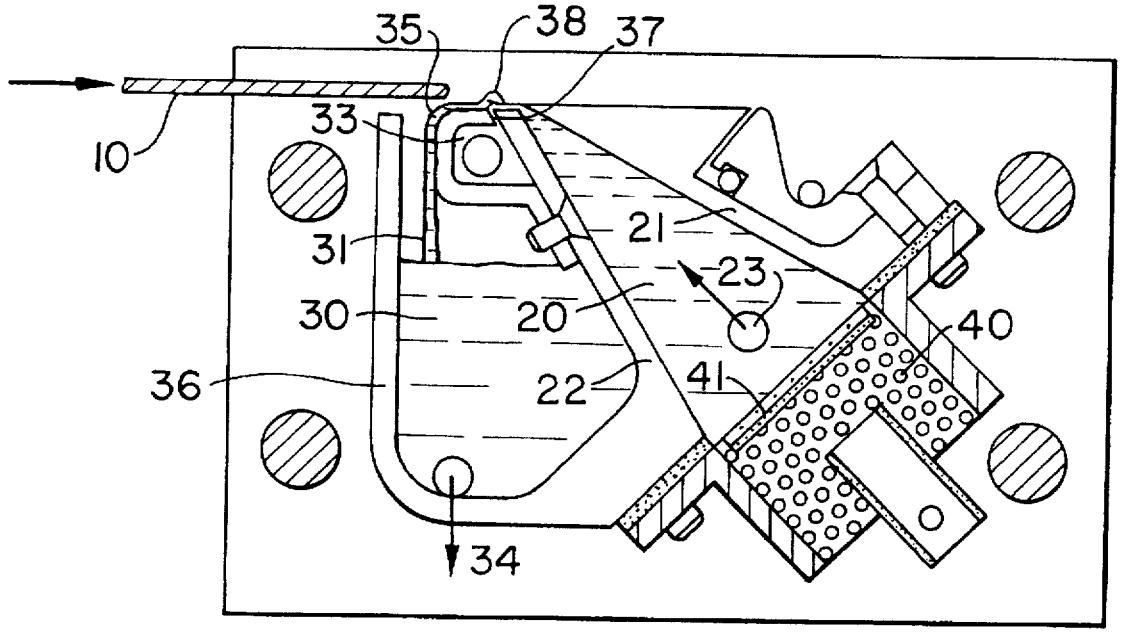
FIG. 1 is a fragmentary vertical section of a coating assembly unit wherein the flowing coating fluid flows in an inclinedly upwardly direction from the upper chamber and the wave generator's lateral slot the of coating applicator's first stage prior to draining over the weir surface.

In accordance with the present invention, FIGS. 1–4 illustrate the processing operations of the coating fluid applicator unit. FIG. 1 shows a fragmented vertical section of the coating fluid unit prior to the coating fluid contacting the substrate surface 10. The coating process is described in two distinct stages: (1) the first or fluid coating stage and (2) the second or excess coating fluid removal/leveling stage. The first stage includes coating fluid/substrate surface interfacial processes occurring downstream of the upper edge of chamber 20's side wall 21 while stage two includes those upstream of the upper edge of side wall 21.

The first coating stage process includes effluent fluid 31 emanating from upper chamber 20, flowing over the wave generating assembly 33 and into the lower chamber 30. The coating fluid entering lower chamber 30 is drained via line 34 for subsequent recycling and/or disposal. In practice, the coating fluid introduced into upper chamber 20 via line 23 flows inclinedly upwardly to contact the inverted surface 10 and then flows over the edge of the wave generating assembly 33 (which defines the lateral weir edge 35). The first wall 22 of the upper chamber 20 abuts the wave generating assembly 33 and is inclined towards the vertical wall 36 of the lower chamber 30. Likewise, the upper wall 21 of the upper chamber 20 is inclined towards the vertical wall 36 of the lower chamber 30; however, the inclined pitch may be more pronounced towards the wave assembly 33. The upper wall 21 is approximately 0.2 mm to about 2 mm higher than the opposing lower wall 22. This vertical height differential and the pitch of the inclined walls 21 and 22 serves to guide and facilitate the coating fluid movement in a direction that overflows over weir edge 35 and opposes the movement of the substrate surface 10 to be coated. Coating fluid dispensed from the lateral slot 37 elevates the coating fluid so as to initiate interfacial contact between the resulting coating fluid wave 38 and substrate surface 10. The distance between the upper surface of the wave generating assembly 33 and the substrate surface 10 of the object to be coated is dependent on coating fluid properties and typically is about 2 mm to about 6 mm.

As depicted in the first stage of the coating applicator assembly illustrated in FIG. 1, megasonic transducer 40 with upper surface 41 forms the bottom surface of chamber 20. The inclined walls 21 and 22 serve to direct coating fluid and focus megasonic acoustic energy over the upper fluid surface contained within chamber 20. Megasonic pressure waves, from about 500 KHz to about 6 MHz and preferably from about 800 KHz to 2 MHz are effective in degassing the substrate surface, thoroughly wetting all surface topographical features and removing particulate materials and soluble contaminants. Such megasonic vibrations transmit shearing forces at the interface between the coating fluid and substrate surface predominately in the direction of the coating fluid flow. As a consequence, these vibrations opposing the movement of the substrate surface 10, serve to facilitate excess coating fluid film to drain over weir edge 35 and into the second chamber 30 which collects the fluid overflow 31.

Manifestly, the surface 10 of the object to be coated and flowing of coating fluid or both may be moved in opposing directions. Typical rates of relative movement are from about 5 cm per minute to about 200 cm per minute.

The second stage of the coating assembly is located immediately downstream of the first stage defined by the upper edge side wall 21. The functions of the second stage include: (1) further insuring intimate fluid/surface interfacial contact; (2) reducing fluid/substrate temperature gradients; (3) removing excess coating fluid previously deposited so as to render a level uniformly thin film coating fluid on substrate surface 10; and (4) draining the meniscus volume so as to reduce film edge thickness buildup prior to coating fluid/substrate surface disengagement. Stage one and stage two coating deposition processes are discussed further in FIGS. 2–4.

Figure 2:
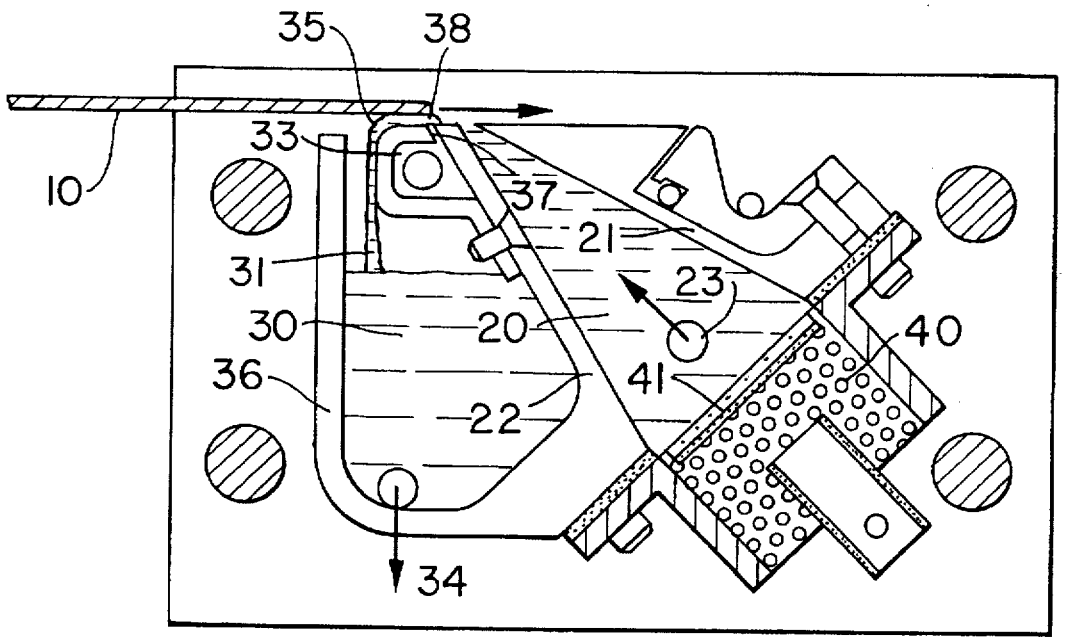
FIG. 2 is a fragmentary vertical section of the weir device illustrated in FIG. 1 showing the coating fluid wave from the first stage of the applicator assembly initiating contact with the inverted substrate surface.

FIG. 2 illustrates the method of establishing a meniscus between the top surface of coating fluid a flowing over weir 35 of the first chamber with respect to inverted substrate surface 10. Coating fluid emanating from lateral slot 37 adjacent to the downstream wall 22 of upper chamber 20 is slightly elevated to form a wave 38. Slot 37 is oriented in an upward inclined direction such that fluid contact is initiated as substrate surface 10 is advanced in a direction opposing the flowing coating fluid. The width of the lateral slot may vary from 0.02 mm to about 0.3 mm with 0.04 to about 0.1 mm preferred.

Figure 3:
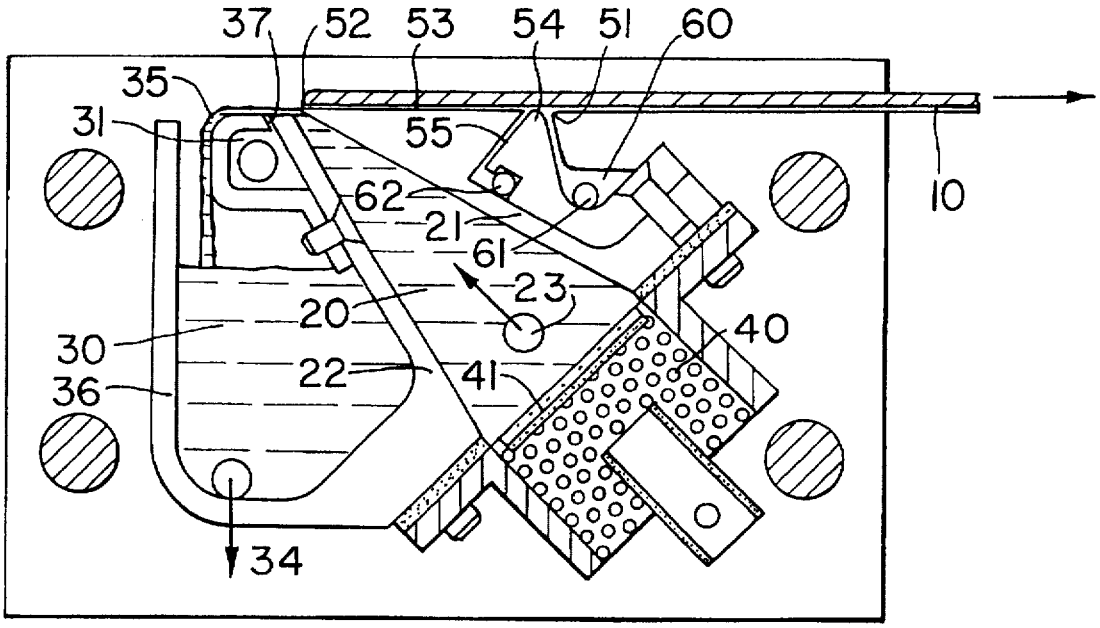
FIG. 3 is a fragmentary vertical schematic view of the coating fluid assembly illustrated in FIGS. 1 and 2 showing the inverted substrate surface scrubbed by the action of megasonic energy to promote surface wetting by the removal of surface adsorbed gases and surface adhering contaminants. Also, shown is the action of the second stage of the coating applicator assembly in performing its coating fluid leveling function by draining excess coating fluid from the leading edge meniscus.

FIG. 3 further shows the wetting of substrate 10 with coating fluid extending between the leading and trailing edge menisci 51 and 52 respectively. The flowing coating fluid from chamber 20 opposes the movement of substrate surface 30 and in concert with the directed megasonic acoustic energies from transducer 40 facilitate the drainage excess coating fluid over weir surface 35.

As illustrated in FIG. 3, the essentially horizontal upper surface 53 of the second stage is elevated from about 0.2 mm to about 0.6 mm above the upper surface of the coating fluid wave generating assembly 33. Its closer proximity to the substrate surface compared to that of the first stage's upper surface in collaboration with fluid shearing forces resulting from the relative movement of the substrate surface and coating applicator assembly effect a drainage of excess fluid over weir edge 54 as defined by the outer boundaries of horizontal surface 53. Weir 54 establishes the position of leading edge meniscus 52 where excess coating fluid from the first stage drains into the second stage's upper fluid overflow collection chamber 60. Fluid in collection chamber 60 subsequently drains to the first stage's lower chamber 30 via drain connector 61. Drain connector 61 consists of a port and a channel in the side plates (not shown) of the coating assembly that facilitates the transport of fluid in chamber 60 to chamber 30 via gravity drainage forces. The extended contact area of the substrate surface 10 with a thin film of flowing coating fluid in contact with horizontal surface 53 serves to reduce interfacial temperature gradients. Approaching isothermal coating fluid deposition conditions has been shown to reduce coating thickness variations.

Figure 4:
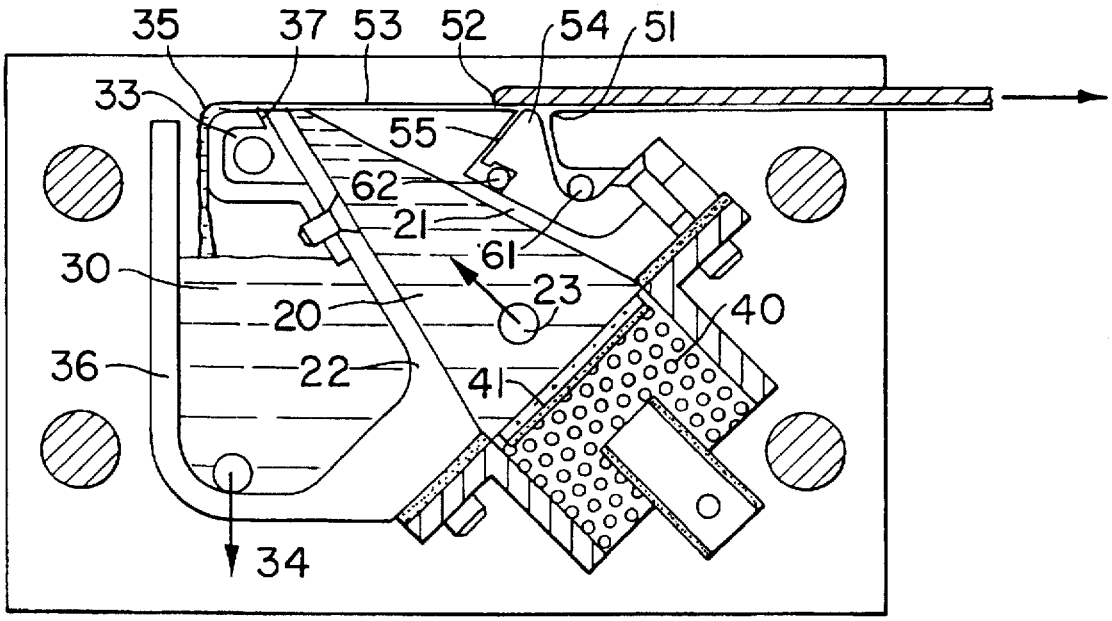
FIG. 4 is a fragmented vertical view of a coating unit as in FIGS. 1–3 illustrating the means employed to minimize the coating fluid volume in the meniscus prior to the disengagement of coating fluid from the substrate surface.

FIG. 4 depicts the means employed to reduce coating thickness variations at the substrate surface's trailing edge. As illustrated, lateral slot 55 located immediately downstream of weir edge 54 is positioned in an inclinedly downward orientation. A suction source (shown in FIG. 5) activated prior to coating fluid/substrate surface disengagement serves to reduce the volume of coating fluid bounded by menisci 51 and 52. Minimizing this volume promotes a more precise break of coating fluid from substrate surface 10.

Figure 5:
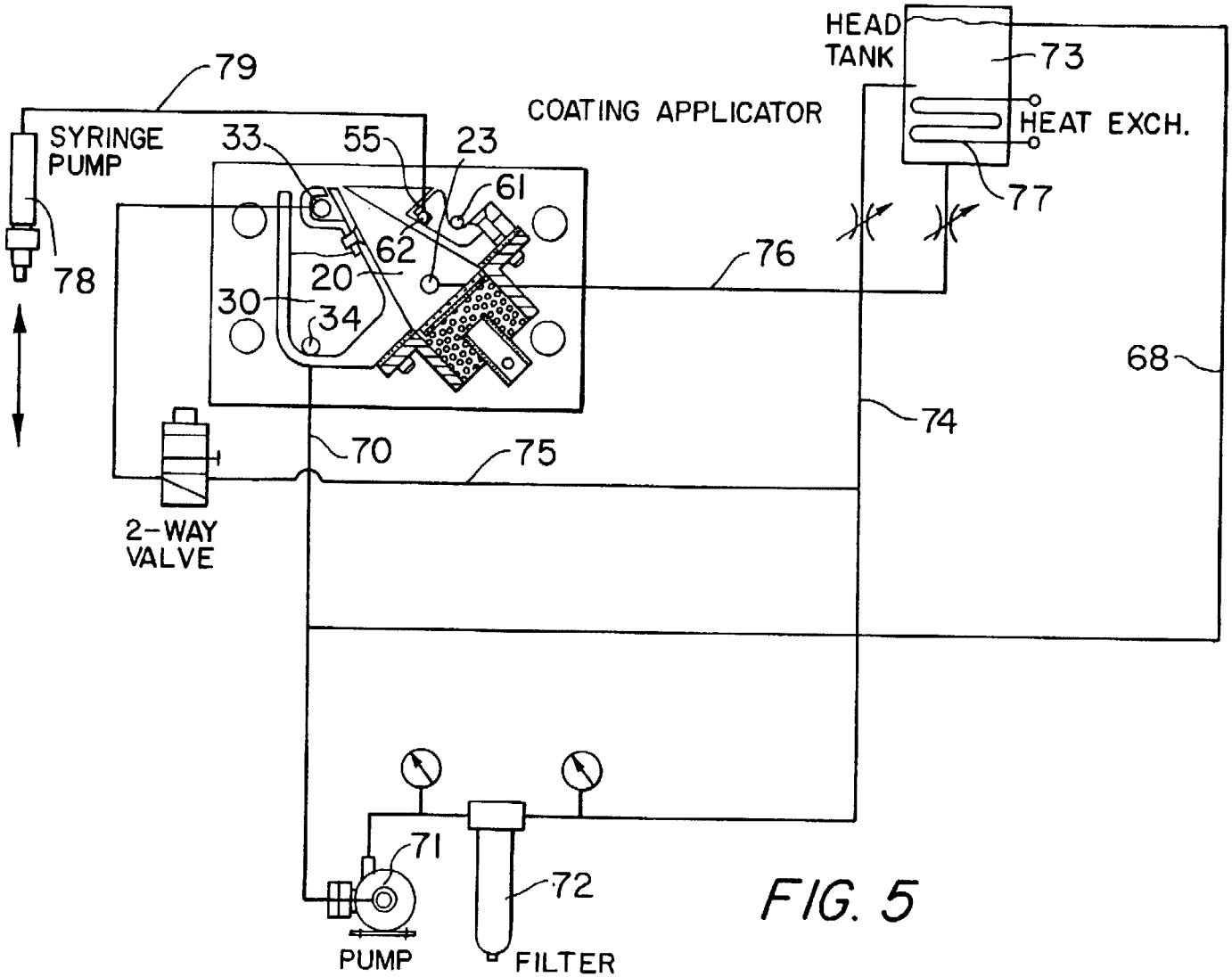
FIG. 5 is a fragmentary vertical schematic view of an installation embodying a typical coating fluid supply and recycle flow scheme in accordance with the present invention.

FIG. 5 details the fluid recirculation, makeup and drainage components of the coating applicator unit. Coating fluid is withdrawn from the lower chamber 30 via line 70 to pump 71. The coating fluid is then passed through particulate filter unit 72. Particulate filtration with at least a 90% retention level of 0.1 micron particulate sizes are preferred to maintain the stringent cleanliness levels required of the coating process. The coating fluid is then directed to head tank 73 and wave generator 33 via lines 74 and 75 respectively. Head tank 73 supplies fluid to chamber 20 via line 76. The coating fluid overflow from head tank 73 is directed to pump 71 via line 68. The vertical positioning of head tank serves to maintain a constant pressure and flow of coating fluid to chamber 20 by precisely controlling the fluid's pressure differential level. The unit's coating fluid volume is not critical to the coating process but typically ranges from about 0.1 liters to about 1 liter. The fluid circulation rates generally vary from about 0.01 volumes of fluid per minute to about 1 volume of fluid per minute.

To reduce vibrational noise resulting from pump 71, the operation of pump 71 can be discontinued during the substrate surface coating process and a constant fluid flow maintained by the elevation level of head tank 73.

Heat exchanger 77 controls the temperature level of the coating fluid by either circulating heating or cooling fluid through heat exchanger 77. The controlled coating fluid temperature contributes to the maintenance of an isothermal surface via the exchange of thermal energies between the surface and coating fluid. A uniform surface temperature contributes to enhancing the uniformity of the coating film deposition process. Temperatures should preferably be less than the coating fluid boiling point or preferably below temperatures where the evaporation of solvent components adversely impacts the coating fluid deposition process. Typical operating temperatures range from about 20° C. to about 75° C. with 20° C. to 30° C. preferred. Elevated operating temperatures contribute to an increase in surface degassing, wetting and subsequent coating film drying rates. It may be anticipated that the introduction of megasonic acoustic energy to the flowing coating fluid in the first chamber 20 contributes to elevating the coating fluid temperature. Temperature rises of about 2° C. to about 5° C. are typical with actual temperature rises being influenced by the fluid flow, ambient temperature and other system and component operating characteristics.

Syringe pump 78 supplies or removes coating fluid to the meniscus draining lateral slot 55 via line 79 connected to slot drain 62. Syringe pump 78 is activated prior to coating fluid/substrate surface disengagement as previously noted. The precise and controlled removals of minute meniscus fluid volumes are accomplished with a syringe pump.

The coating process is intended to take place at ambient pressure levels; however, coating may be performed under vacuum, pressurized, and/or inert gas environments to control operating processing conditions and/or prevent coating solvent vapors from contaminating the surrounding environment.

Figure 6:
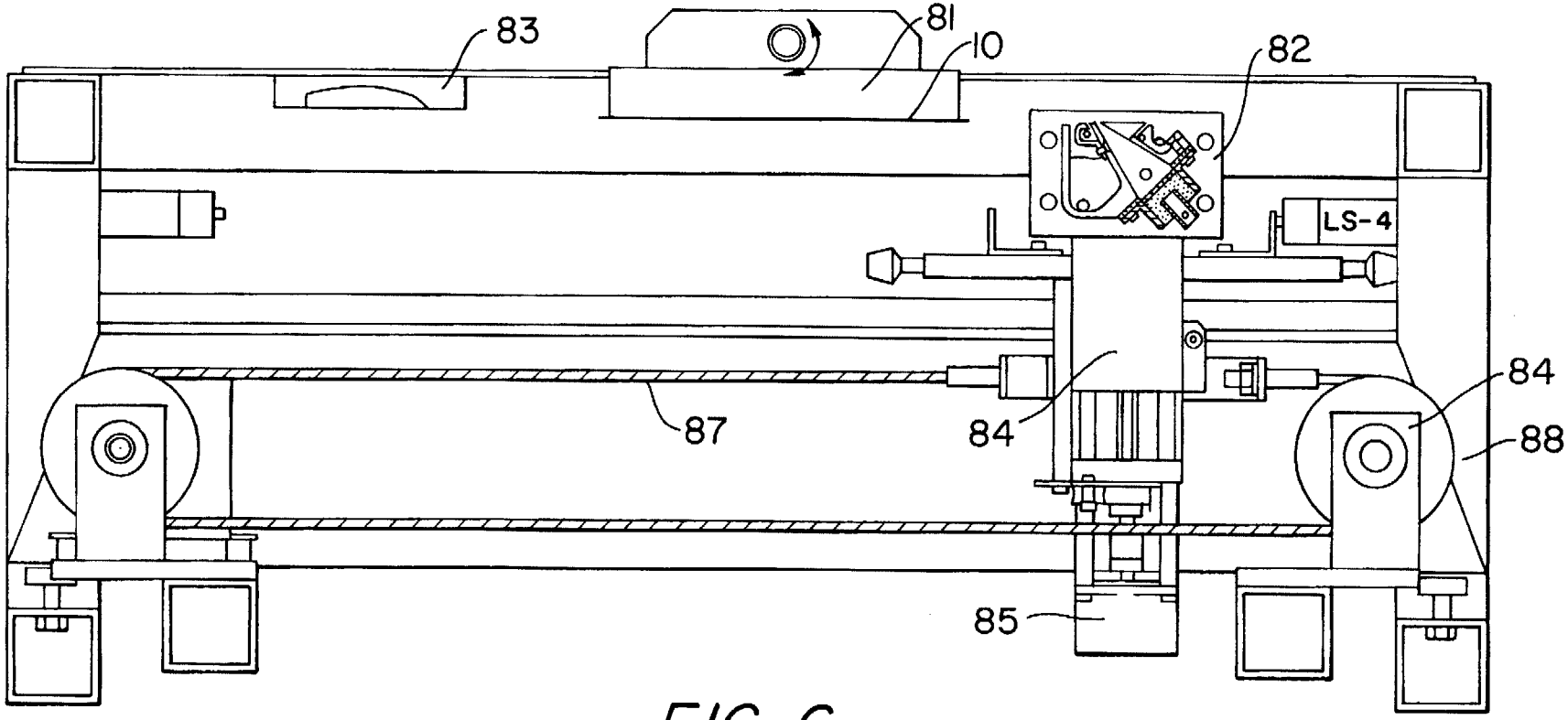
FIG. 6 is a front elevation view of a coating process module, according to the present invention.
Figure 7:
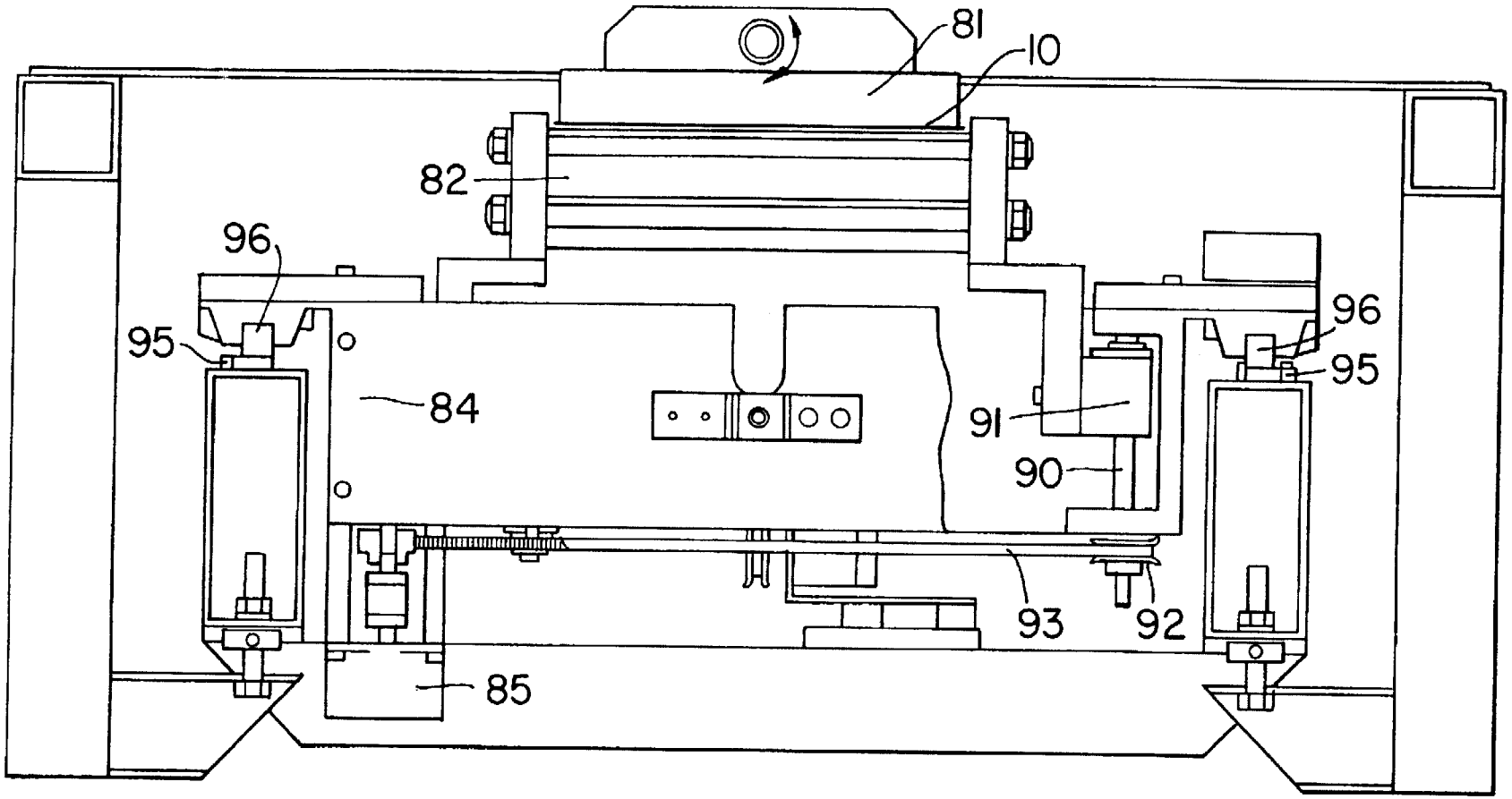
FIG. 7 is a side elevation view of a coating process module as in FIG. 6, according to the present invention.

FIGS. 6 and 7 illustrate an apparatus suitable for practicing the present invention. FIG. 6 is a front view and FIG. 7 is a side view of an apparatus of the subject coating process.

The substrate 10 is placed on the vacuum chuck 81 and subsequently inverted and the surface coated in a continuous processing manner. Several means of automatically feeding flat substrate surfaces are readily available for continuous processing usage. For example, robotic cassette fixtures may be employed for loading and unloading the flat substrate surfaces to and from the coating processing unit. Additionally, the coating apparatus noted in FIGS. 6 and 7 may be integrated with etching, stripping, cleaning, rinsing and drying processing modules prior to coating and, also, solvent drying, baking, curing and other processing functions after application of a film coating to the substrate surface.

As noted in FIGS. 6 AND 7, substrate 10 is placed on vacuum chuck assembly 81 in order to support the substrate surface 10 of the object to be coated in an inverted position. After rotating the vacuum chuck assembly 81 with the mounted substrate surface 10 in an inverted horizontal orientation, coating assembly 82 which is supported on a vertical lifting platform 84 driven by stepper motor 85 positions vertical elevation of coating assembly 82. Three positioning elevation of coating assembly 87 include: (1), a precise distance from substrate surface 10 usually from about 2–6 mm; (2) a vertical elevation where the top of the coating assembly 82 engages coating assembly lid 83 at the hold position; (3) at a vertical elevation which allows coating assembly 82 to traverse from the hold to the start position without the substrate 10.

The coating assembly 82 and lift platform 84 advance from the start (shown in FIG. 6) to the hold position by means of a precisely controlled moving linear cable drive mechanism 86 equipped with roller bearings and precision tracks (shown in FIG. 7). The variable speed DC motor which drives cable 87 via pulley 88 is not shown.

When the fluid coating cycle is initiated and the coating assembly 82 is at the hold position, stepper motor 85 lowers the coating assembly 82 and then proceeds to traverse to the start position. The vertical elevation of the coating assembly platform 84 is then adjusted to the precise coating height elevation level via stepper motor 85 after which the coating scanning movement is initiated. Upon reaching the leading edge of the applicator, coating fluid is applied to the inverted substrate surface 10. The coating assembly 82 continues to move to the hold position and, upon coming to a stop, the coating assembly 82 is raised by activation of stepper motor 85 to engage the applicator assembly's cover lid 83. Cover lid 83 seals the top of coating assembly 82 to minimize the evaporation of the coating fluid's solvent content. Make-up solvent can be introduced to compensate for solvent loss incurred during coating processing.

FIG. 7 further illustrates a side view of the coating mechanisms. Screw assembly 90 and housing 91 provide for the precise vertical elevation positioning via rotation of pulley 92 by belt 93. The entire lift mechanism 84 traverses linearly over tracks 95 and roller 96.

Many other modifications are conceivable within the scope of the invention. Although the invention has been described with respect to specific aspects, those skilled in the art will recognize that substitution of elements may be employed without departing from the spirit of the attached claims.

We claim:

1. Method of applying a uniform fluid coating to inverted flat substrates, comprising:

a. horizontally moving and inverting a substrate in a relatively countercurrent direction to a coating fluid applicator, such that the substrate shields contaminants from settling upon a surface of the substrate being coated;

b. flowing coating fluid inclinedly upwardly towards the substrate and oppositely to said horizontally moving of the substrate, including laterally dispersing said coating fluid while flowing coating fluid inclinedly upwardly at a desired point of contact with the substrate surface and in proximity to a weir surface;

c. megasonically vibrating said flowing coating fluid in parallel to the direction of said flowing coating fluid by means of megasonic vibrations introduced to said flowing coating fluid at a frequency of 600 KHz to 2 MHz so as to promote substrate surface wetting by the displacing of substrate surface adsorbed gases, solubilizing of adhering surface contaminants and expediting the penetration of coating fluid into the substrate surface;

d. elevating said flowing coating fluid from 1 to 200 mils toward the substrate surface at a point adjacent the substrate surface, such that said flowing coating fluid contacts and coats the substrate surface, while forming a leading edge meniscus and a trailing edge meniscus between said flowing coating fluid and said horizontally moving substrate, and e. subsequently of coating fluid contacting the substrate surface, withdrawing by suction a portion of the volume of flowing coating fluid from the leading edge meniscus, then, prior to disengagement, between flowing coating fluid and the moving substrate surface, draining excess coating fluid from the trailing edge meniscus and over the weir surface.

2. Method of applying a uniform fluid coating to inverted substrates as in claim 1, including recirculating said flowing coating fluid.

3. Method of of applying a uniform fluid coating to inverted substrates as in claim 1, including filtering of said flowing coating fluid during said recirculating, so as to remove particulate materials.

4. Method of applying a uniform fluid coating to inverted substrates as in claim 3, including heating said flowing coating fluid at temperatures less than the coating fluid boiling point, thereby heating the substrate surface to be coated and enhancing solubilization of contaminants and enhancing drying rates of adhering coating fluid films.

5. Method of applying a uniform fluid coating to inverted substrates as in claim 4, including rotating the substrate surface after the application of a fluid coating film so as to enhance leveling and drying of coating fluid.

* * * * *